US007906182B1

(12) United States Patent
Schlaf

(10) Patent No.: US 7,906,182 B1
(45) Date of Patent: Mar. 15, 2011

(54) METHOD OF THIN FILM ELECTROSPRAY DEPOSITION

(75) Inventor: Rudiger Schlaf, Tampa, FL (US)

(73) Assignee: University of South Florida, Tampa, FL (US)

( * ) Notice: Subject to any disclaimer, the term of this patent is extended or adjusted under 35 U.S.C. 154(b) by 190 days.

(21) Appl. No.: 12/353,283

(22) Filed: Jan. 14, 2009

Related U.S. Application Data

(60) Provisional application No. 61/021,743, filed on Jan. 17, 2008.

(51) Int. Cl.
*B05D 1/04* (2006.01)

(52) U.S. Cl. ..... 427/483; 427/475; 427/485

(58) Field of Classification Search ..... 427/475, 427/483, 485
See application file for complete search history.

(56) References Cited

U.S. PATENT DOCUMENTS

| | | | | |
|---|---|---|---|---|
| 4,242,374 | A | 12/1980 | Sansregret | |
| 5,087,476 | A | 2/1992 | Tohma et al. | |
| 5,143,139 | A | 9/1992 | Leatham et al. | |
| 7,259,109 | B2 * | 8/2007 | Meagley | 438/778 |
| 2006/0233941 | A1 | 10/2006 | Olson | |

* cited by examiner

*Primary Examiner* — Frederick J Parker
(74) *Attorney, Agent, or Firm* — Courtney M. Dunn; Smith & Hopen, P.A.

(57) ABSTRACT

A method of forming a smooth thin film on a substrate within a short deposition time, the method comprising introducing ionic substances (salts, acids, bases) to a polymeric solution to be sprayed. These ions attach to the polymer strands in solution, increasing their charge to mass ratio. This results in mutual repulsion of the strands during the spray process and produces a smooth film, even at relatively high polymeric solution concentrations. A side effect of this process is the introduction of impurities (the added ions) to the polymer thin film. The proper choice of ionic compound allows a dissolution step to be used to "clean" the polymer film after deposition, using the solubility characteristics of the thin film versus the ionic compound.

10 Claims, 4 Drawing Sheets

METHOD OF THIN FILM ELECTROSPRAY DEPOSITION

CROSS REFERENCE TO RELATED APPLICATIONS

This application claims priority to currently pending U.S. Provisional Patent Application No. 61/021,743, filed Jan. 17, 2008.

STATEMENT OF GOVERNMENT INTEREST

This invention was made with Government support under Grant NSF DMR 0510000, awarded by the National Science Foundation, Division of Materials Research. The government has certain rights in the invention.

FIELD OF THE INVENTION

This invention relates to depositing films from highly concentrated solutions. More specifically, the invention is a method for electrospraying highly concentrated solutions and obtaining a substantially two-dimensional thin film.

BACKGROUND

Electrospray is a method of applying thin film coatings in industrial applications. As the coating solution passes through a nozzle, the solution is subject to an electrical charge. The charged solution repels itself and, upon exiting the nozzle, disperses into small, highly charged droplets. While aerosolized, the solution rapidly looses solvent, due to the high surface volume, causing the base to increase in electrical charge.

Many polymeric materials do not form ions in solution. Electrospray thin film deposition of high concentrations of such polymer solutions often result in the deposition of rough films, or strongly three-dimensional films, probably caused by Van der Waals attractions or hydrophilic/hydrophobic interaction between single polymer strands. This phenomenon becomes especially noticeable if solutions of above certain polymer concentration are used. In order to fabricate smooth continuous films, the concentration needs to be kept low, which results in long deposition times. A method is needed in the art that provides for shorter deposition times and increased film quality.

SUMMARY OF INVENTION

Methods currently available for the fabrication of smooth continuous thin films by electrospray deposition have the problem of long deposition times. The present invention addresses this problem through the addition of ionic substances to the sprayed polymer solution, allowing the use of high concentrations. This results in much shorter deposition times, while increasing film quality.

In an embodiment, the method of electrospray deposition comprises combining a polymer solution that does not form ions in solution and an ionic substance to form a polymer-ion solution, and electrospraying the polymer-ion solution to solitarily deposit polymer strands on the surface of a substrate. The polymer solution may be a high-concentration polymer solution. The polymer solution may comprise a polylactic acid (PLA) and dicloromethane (DCM), wherein the concentration of PLA acid is about 10 mg/ml. The ionic substance may be tetrabutylammonium hexafluorophosphate (TBH) or salicylic acid (SA). The concentration of the ionic substance may be between about 0.1 mg/ml and about 5 mg/ml or the ionic substance may comprise about 10% of the polymer-ion solution.

In another embodiment, electrospraying the polymer-ion solution is completed with a flow rate of about 0.16 ml/hr for about two minutes, at a voltage of about 2.0 kV to about 2.5 kV and the distance between the syringe tip of the electrospray device and the sample being sprayed is about 25 mm.

In an additional embodiment, the polymer strands may deposit solitarily on the surface before complete evaporation occurs.

Also provided is an ionic coating composition for use in electrospray deposition. The ionic coating composition comprises a high-concentration polymer solution that does not form ions in solution and an ionic substance mixed with the polymer solution, wherein the ionic substance comprises about 10% of the polymer-ion solution. The polymer solution may be PLA. The polymer solution may comprise PLA and DCM, wherein the concentration of PLA is about 10 mg/ml. The ionic substance may be selected from the group comprising TBH and SA. The concentration of the ionic substance may be between about 0.1 mg/ml and about 5 mg/ml.

The fabrication method of the present invention has the side effect of introducing impurities to the polymer thin film. The present invention also provides a method of cleaning impurities from the polymer thin film after electrospray deposition.

In an embodiment, the method of cleaning ionic material from a polymer-ion thin film comprises providing a substrate for depositing the polymer-ion thin film on, providing a polymer-ion solution, electrospraying the polymer-ion solution on to the substrate, whereby polymer strands deposit solitarily on the surface of the substrate to create the polymer-ion thin film, providing a solvent in which the polymer of the polymer-ion thin film is less soluble than the ionic substance of the polymer-ion thin film, and introducing the solvent to the polymer-ion film. The solvent may be water and the polymer-ion solution may comprise DCM, PLA, and SA.

BRIEF DESCRIPTION OF THE DRAWINGS

For a fuller understanding of the invention, reference should be made to the following detailed description, taken in connection with the accompanying drawings, in which:

FIG. 5A is a SEM image, at 1,000× magnification, of a PLA film from a pure solution.

FIG. 5B is a SEM image of the same PLA film of FIG. 5A, but at 3,500× magnification.

FIG. 5C is a SEM image, at 1,000× magnification, of a PLA film from a solution with SA concentrations of 0.1 mg/ml.

FIG. 5D is a SEM image of the same PLA film of FIG. 5C, but at 3,500× magnification.

FIG. 5E is a SEM image, at 1,000× magnification, of a PLA film from a solution with SA concentrations of 1 mg/ml.

FIG. 5F is a SEM image of the same PLA film of FIG. 5E, but at 3,500× magnification.

FIG. 5G is a SEM image, at 1,000× magnification, of a PLA film from a solution with SA concentrations of 2 mg/ml.

FIG. 5H is a SEM image of the same PLA film of FIG. 5G, but at 3,500× magnification.

FIG. 5I is a SEM image, at 1,000× magnification, of a PLA film from a solution with SA concentrations of 5 mg/ml.

FIG. 5J is a SEM image of the same PLA film of FIG. 5I, but at 3,500× magnification.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

The present invention solves the problem of low-concentration/rough-coating application by introducing ionic substances (salts, acids, bases) to the solution to be sprayed.

Figure 1:
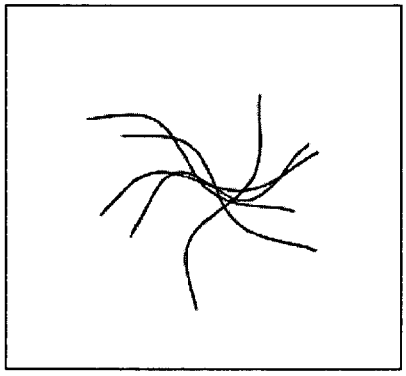
FIG. 1 is a schematic diagram of pure polymer solution, whereby the polymer concentration is beyond a certain threshold. Without ionic compounds added, clustering occurs, which can result in a three-dimensional deposit during the electrospray deposition procedure.
Figure 2:
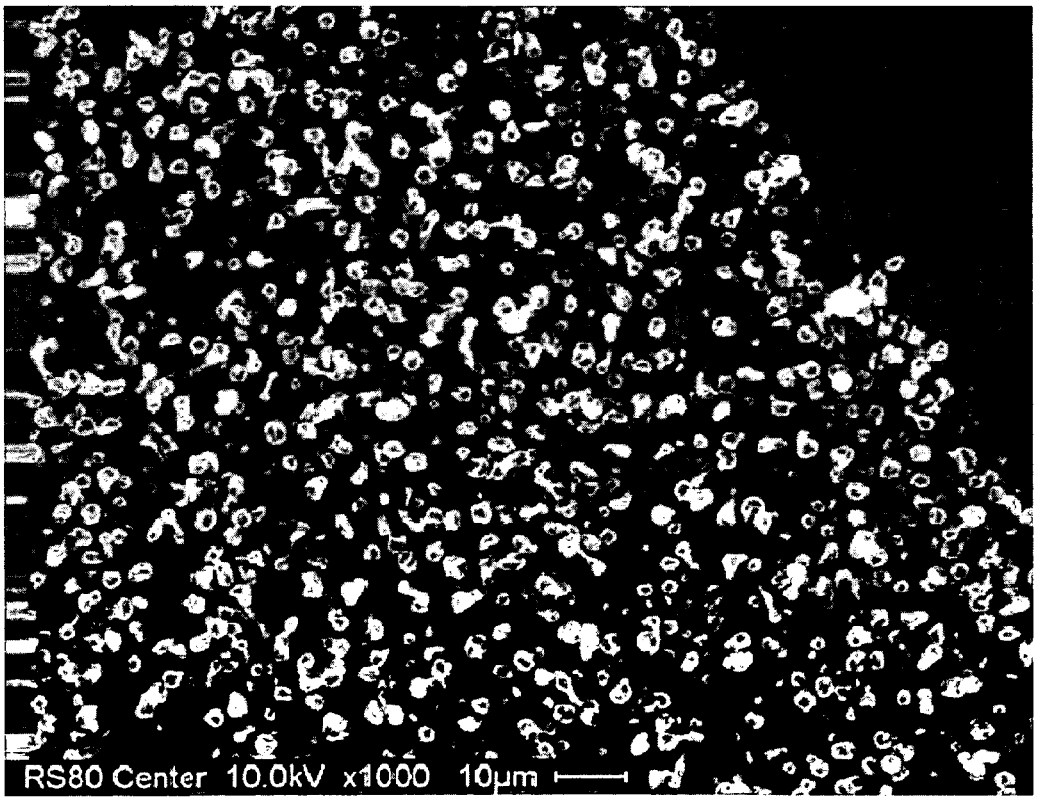
FIG. 2 is an SEM image of polylactic acid (PLA) film deposited from pure solution, showing the resultant rough film.

An illustration of pure polymer solution is shown in FIG. 1. When sprayed, droplets of the solution form. As the droplets fly towards the substrate, their size shrinks, i.e. the concentration of the polymers increases. At a certain point, due to Van der Waals attraction or a similar mechanism, the polymers are attracted to each other because there is no longer enough solvent to keep them separate (i.e. they precipitate). The formed clusters are subsequently deposited. This can result in a three-dimensional deposit. An example of a thin film created with a pure polymer solution is shown in FIG. 2. The scanning electron microscopy (SEM) image shows a polylactic acid (PLA) film deposited from pure solution via electrospray from a 10 mg/ml solution. The solvent used for this example was dichloromethane (DCM). The spray parameters included a syringe tip-to-sample distance of 25 mm, voltage of 2.1 kV, a flow rate of 0.16 ml/hour, and a spray time of 2 minutes. It is evident that no real thin film is formed, but that instead strong clustering occurs. The cluster size is several microns.

Figure 3:
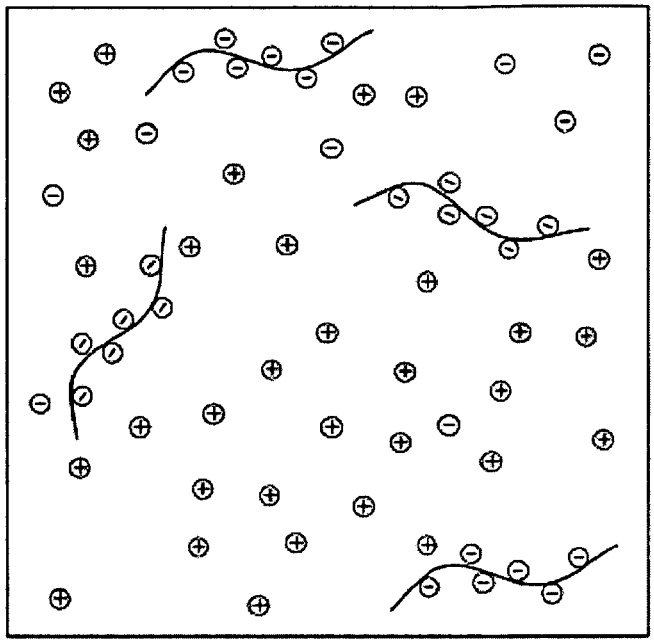
FIG. 3 is a schematic diagram of ion-added polymer solution, whereby the polymer concentration is beyond a certain threshold. With ions added to the solution, the polymer strands remain separated due to attachment of ions of equal polarity, which helps form a smooth film deposition.
Figure 4:
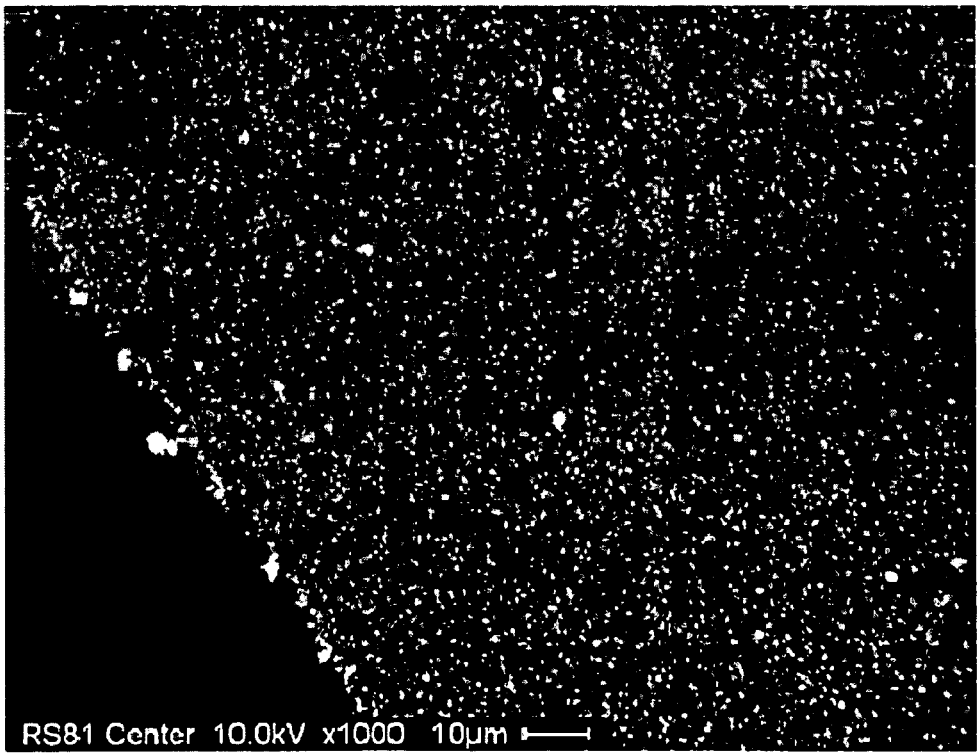
FIG. 4 is an SEM image of PLA film deposited from a solution with an added ionic compound (Tetrabutylammonium hexafluorophosphate; TBH). The addition of TBH leads to a smoother film than a non-ionic solution.

The addition of an ionic solvent causes ions to attach to the polymer strands in solution, illustrated in FIG. 3. Ions of one polarity are more likely to attach to the polymer than the other due to the applied electrospray voltage, which creates a net surplus of ions of one polarity, as well as the specific steric and chemical conditions each ionic species faces during adduction. This creates a net charge of a certain polarity on the polymer strands, which causes electrostatic repulsion between them. This alters the spray process. As the particles shrink on their way to the substrate, the high numbers of charges present in this type of solution increases the charge to mass ratio and leads to an instability of the droplets as the solvent evaporates. This results in mutual repulsion of the strands during the spray process. When the force between the molecules surpasses a certain level, ion-attached polymer strands become ejected and deposit solitarily on the surface. It is also possible, if droplets hit the substrate before complete evaporation occurs, for the high-charge state of the polymer strands to result in a wider distribution of solute on the surface as evaporation occurs, also resulting in a smoother, more two-dimensional deposit. A smooth film results even at relatively high concentrations, as shown in the example in FIG. 4. The SEM image shows the resultant coating after adding an ionic compound, 1 mg/ml Tetrabutylammonium hexafluorophosphate (TBH; a standard salt used to prepare electrolytes from organic solvents), to the PLA solution. The deposition of the same mass of PLA was the same as in the example of FIG. 2 (i.e. identical deposition parameters and time). A continuous film has formed showing a much reduced particle size/roughness.

Figure 5A:
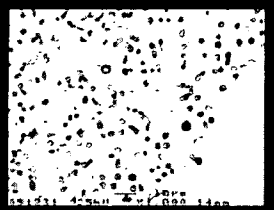
FIGS. 5A through 5J are SEM images of PLA films deposited from pure solution (FIGS. 5A and 5B) and from solutions with gradually added salicylic acid (SA) concentrations (FIGS. 5C through 5J) at magnifications of 1000× (left column) and 3500× (right column) magnification.
Figure 5B:
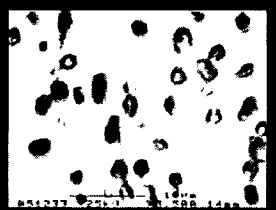
Figure 5C:
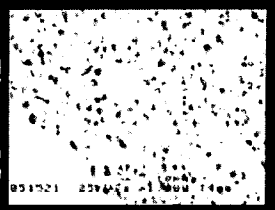
Figure 5D:
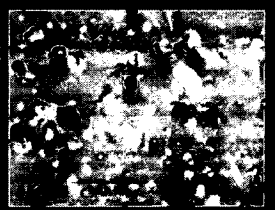
Figure 5E:
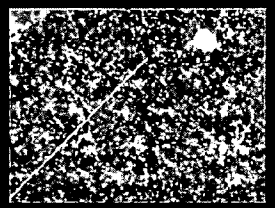
Figure 5F:
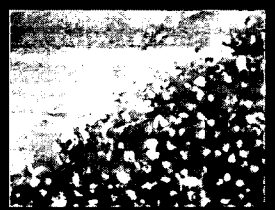
Figure 5G:
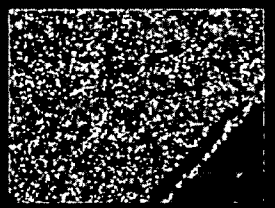
Figure 5H:
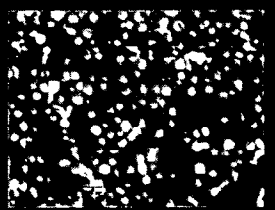
Figure 5I:
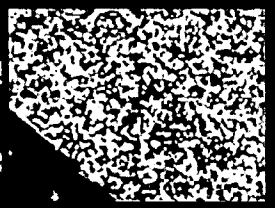
Figure 5J:
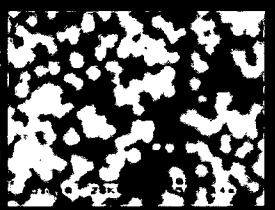

Another example is shown in FIGS. 5A-J. Here, salicylic acid (SA) was added to the 10 mg/ml (in DCM) PLA solution in concentrations ranging from 0.1 mg/ml to 5 mg/ml (FIGS. 5A and 5B: pure PLA; FIGS. 5C and 5D: SA 0.1 mg; FIGS. 5E and 5F: SA 1 mg; FIGS. 5G and 5H: SA 2 mg; FIGS. 5I and 5J: SA 5 mg). The left column (FIGS. 5A, 5C, 5E, and 5H) shows SEM images of the produced films at 1,000× magnification, while the right column (FIGS. 5B, 5D, 5F, and 5I) shows areas on the same samples at 3,500× magnification. The spray parameters included a syringe tip-to-sample distance of 25 mm, a voltage of 2.5 kV, a flow rate of 0.16 ml/hr, and a spray time of two minutes. As can be seen in FIGS. 5A through 5J, the morphology of the deposited film changes dramatically as the acid concentration increases. The highly three-dimensional clusters of the pure PLA deposition change to much flatter spots at higher SA concentration.

Figure 6:
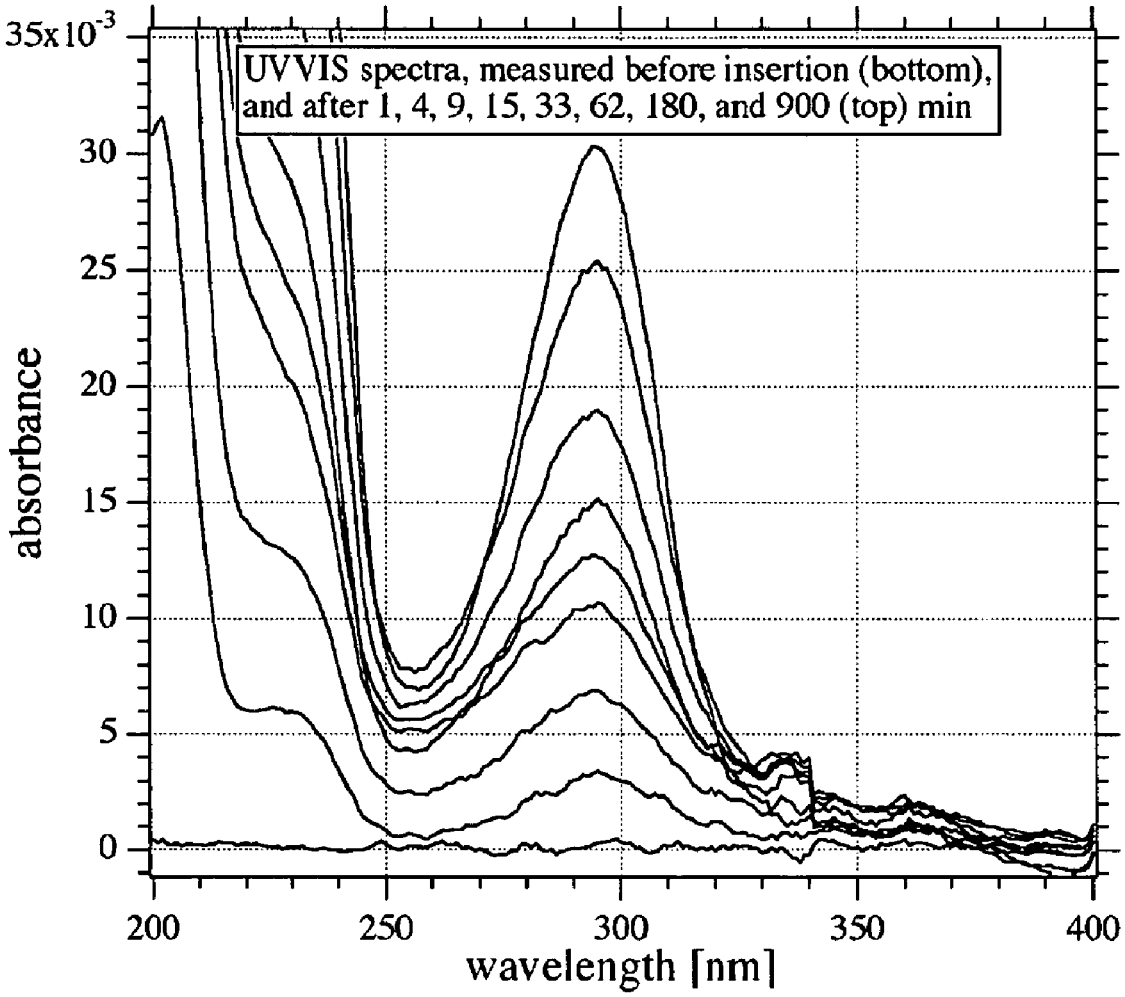
FIG. 6 is a graph of the UVVIS absorbance spectra of SA during elution from a PLA/SA composite film. Over a period of 900 minutes most of the SA is released into the water from the PLA matrix, causing increased absorption around 295 nm.

This process has the side-effect of introducing impurities (the added ions) to the polymer thin film. By properly choosing the ionic compound a simple dissolution step can be used to "clean" the polymer film after deposition. If the ionic substance is soluble in a solvent in which the polymer does not dissolve, then the ionic substance can be removed from the film after deposition by inserting the substrate into this solvent. As as example, salicylic acid (SA) was added to the PLA solution. While SA is soluble in DCM, as is PLA, SA is also soluble in water, whereas PLA dissolves only very weakly in water (i.e. takes many magnitudes longer than SA to dissolve). After insertion of the PLA/SA films into water, the release of the co-deposited SA ions could be detected using ultraviolet-visible spectroscopy (UVVIS). After a few minutes of insertion time, a UVVIS absorbance signal was measured similar to the signal obtained by depositing an identical amount of pure SA from DCM solution and then re-dissolving into water. The UVVIS spectra measured during this process are shown in FIG. 6. The peak at 295 nm corresponds to the absorbance of SA in water. Over a time span of 900 minutes this peak strongly increases as the SA molecules are eluted into the water. This demonstrates that the co-deposited SA was removed by the insertion of into water, and that a pure PLA film remained.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between. Now that the invention has been described,

What is claimed is:

1. A method of electrospray deposition comprising:

providing a polymer solution that does not form ions in solution;

providing an ionic substance;

combining the ionic substance and the polymer solution; and electrospraying the polymer-ion solution to form polymer strands on a substrate, whereby the polymer strands are deposited solitarily on a surface of the substrate.

2. The method of claim 1, wherein the polymer solution is a high-concentration polymer solution.

3. The method of claim 1, wherein the polymer solution comprises a polylactic acid (PLA) and dicloromethane (DCM), wherein the concentration of PLA is about 10 mg/ml.

4. The method of claim 1, wherein the ionic substance is selected from the group comprising tetrabutylammonium hexafluorophosphate (TBH) and salicylic acid (SA).

5. The method of claim 1, wherein the concentration of the ionic substance is between about 0.1 mg/ml and about 5 mg/ml.

6. The method of claim 1, wherein the ionic substance comprises about 10% of the polymer-ion solution.

7. The method of claim 1, wherein electrospraying the polymer-ion solution is completed with a flow rate of about 0.16 ml/hr for about two minutes, at a voltage of about 2.0 kV to about 2.5 kV and the distance between the syringe tip of the electrospray device and the sample being sprayed is about 25 mm.

8. The method of claim 1, wherein the polymer strands deposit solitarily on the surface before complete evaporation occurs.

9. A method of cleaning ionic material from a polymer-ion thin film, the method comprising:

providing a substrate for depositing the polymer-ion thin film on;

providing a polymer-ion solution;

electrospraying the polymer-ion solution on to the substrate, whereby polymer strands are formed and deposited solitarily on a surface of the substrate to create the polymer-ion thin film;

providing a solvent in which the polymer of the polymer-ion thin film is less soluble than the ionic substance of the polymer-ion thin film; and introducing the solvent to the polymer-ion film.

10. The method of claim 9, wherein the solvent is water, the polymer-ion solution comprises DCM, PLA, and SA.

* * * * *